US007524802B2

(12) United States Patent
Coley

(10) Patent No.: US 7,524,802 B2
(45) Date of Patent: Apr. 28, 2009

(54) COMPOSITIONS FOR USE IN VEHICLE WASH COMPRISING A MICRO-ORGANISM

(75) Inventor: Paul Stuart Coley, Hertfordshire (GB)

(73) Assignee: Autoglym, Hertfordshire (GB)

( * ) Notice: Subject to any disclaimer, the term of this patent is extended or adjusted under 35 U.S.C. 154(b) by 429 days.

(21) Appl. No.: 10/517,085

(22) PCT Filed: Jun. 9, 2003

(86) PCT No.: PCT/GB03/02455

§ 371 (c)(1),
(2), (4) Date: Jan. 13, 2005

(87) PCT Pub. No.: WO03/104376

PCT Pub. Date: Dec. 18, 2003

(65) Prior Publication Data

US 2005/0176608 A1 Aug. 11, 2005

(30) Foreign Application Priority Data

Jun. 7, 2002 (GB) ..... 0213097.9

(51) Int. Cl.
*C11D 17/00* (2006.01)

(52) U.S. Cl. ..... 510/189; 510/202; 510/424; 510/461; 510/488

(58) Field of Classification Search ..... None
See application file for complete search history.

(56) References Cited

U.S. PATENT DOCUMENTS

| | | | | |
|---|---|---|---|---|
| 3,609,089 | A * | 9/1971 | Cantrell et al. | 134/40 |
| 5,525,255 | A | 6/1996 | Leadingham et al. | 252/174.12 |
| 5,863,882 | A | 1/1999 | Lin et al. | 510/397 |
| 5,871,590 | A | 2/1999 | Hei et al. | 134/26 |
| 6,008,261 | A * | 12/1999 | Genova et al. | 516/58 |
| 6,376,451 | B1 | 4/2002 | Teasdale et al. | 510/392 |
| 6,475,290 | B2 * | 11/2002 | Jones | 134/2 |

FOREIGN PATENT DOCUMENTS

| | | |
|---|---|---|
| DE | 2651483 | 5/1977 |
| DE | 19525124 | 1/1997 |
| EP | 0436090 | 7/1991 |
| EP | 0450459 | 10/1991 |
| EP | 0588282 | 3/1994 |
| EP | 0761094 | 3/1997 |
| JP | 58-133943 | 8/1983 |
| JP | 08-245992 | 9/1996 |
| JP | 10-237491 | 9/1998 |
| JP | 1190114 | 4/1999 |
| JP | 2000-127913 | 5/2000 |
| JP | 2001-321777 | 11/2001 |
| WO | 0063338 | 10/2000 |
| WO | 0123511 | 4/2001 |
| WO | 0149296 | 7/2001 |

* cited by examiner

*Primary Examiner*—Necholus Ogden
(74) *Attorney, Agent, or Firm*—Baker Botts LLP

(57) ABSTRACT

The invention relates to a composition suitable for use as in a vehicle wash which composition includes a micro-organism to digest organic matter washed from the vehicle. By including a microorganism in wash water used in a vehicle wash, there are various advantages including the fact that dosing of the vehicle wash by the micro-organism is proportional to the use of the vehicle wash. Thus the more the vehicle wash is used, generally the more organic matter will accumulate but as dosing is proportional to use, more micro-organism is supplied to combat the increased level of organic matter. As a result the growth rate of organic matter is greatly reduced allowing wash water to be recycled for longer resulting in reduced operating costs for the vehicle wash, especially as there is less or no need to apply a biocide to control foul odour.

25 Claims, No Drawings

COMPOSITIONS FOR USE IN VEHICLE WASH COMPRISING A MICRO-ORGANISM

CROSS REFERENCE TO RELATED APPLICATIONS

The present application is a national phase of International Patent Application No. PCT/GB03/02455, filed Jun. 9, 2003, published on Dec. 18, 2003 as International Patent Publication No. WO 03/104367, which claims priority to Great Britain Patent Application Serial No. 0213097.9, filed on Jun. 7, 2002, the contents of which are hereby incorporated by reference in their entirety herein.

The present invention provides a new biodegradable detergent composition and wash water additive for use in a vehicle wash and methods of operating a vehicle wash using the detergent composition or additive.

A problem in vehicle wash areas is that organic material washed from the vehicles accumulates. As a result the vehicle wash area must be cleaned from time to time and the contaminated water in the sump of the vehicle wash must occasionally be emptied. A further problem is that the material can rot leading to the production of foul odours or it can promote the growth of algae. Normally attempts are made to control foul odours by applying a biocide. Commonly commercial vehicle washes have water collection tanks to which waste wash water can drain. It is known to dose such water collection tanks with a preparation of micro-organisms to digest the organic material in the waste water. It is now recognised that such dosing is inconvenient and, for it to be effective, the operator of the commercial vehicle wash must remember to do it.

A way of ameliorating these problems has been sought.

According to the invention there is provided a detergent composition suitable for use in a vehicle wash which composition includes a micro-organism and a detergent.

According to the invention there is further provided a wash water additive for use in wash water in a vehicle wash which additive includes a micro-organism.

According to the invention there is also provided a method of operating a vehicle wash which includes means for dispensing water, means for dispensing a detergent composition and optionally one or more vehicle washing devices, which method includes providing a micro-organism in the detergent composition and/or in the wash water.

By including a micro-organism in the detergent composition or in wash water used in a vehicle wash, there are various advantages including the fact that dosing of the vehicle wash by the micro-organism is proportional to the use of the vehicle wash. Thus the more the vehicle wash is used, generally the more organic matter will accumulate but as dosing is proportional to use, more micro-organism is supplied to combat the increased level of organic matter. As a result the growth rate of organic matter is greatly reduced allowing wash water to be recycled for longer resulting in reduced operating costs for the vehicle wash, especially as there is less or no need to apply a biocide to control foul odour.

A further advantage is that the micro-organism is sprayed with the detergent composition or wash water and so it can reach all parts of the vehicle wash. Therefore accumulation of organic material in inaccessible parts of a vehicle wash can be prevented by the use of the composition or additive according to the invention or of the method according to the invention.

Vehicle wash areas can be slippery because of organic films or algae growth. Eventually it is necessary to clean vehicle washes to deal with this problem. A further advantage of the invention is that this problem is reduced without the need for additional cleaning.

The invention may be applied to a vehicle wash which is suitable for washing a car, bus, lorry, caravan or train. Preferably it is for use with a car or a bus wash. The vehicle wash optionally is operated either automatically (e.g. a drive-through vehicle wash) or manually.

A range of micro organisms may be used as the micro organism in the invention. Preferably the micro organism is naturally occurring. More preferably the micro organism is capable of degrading organic matter, particularly that washed from a vehicle, more particularly oil, fat and/or organic material such as dirt e.g. soil, plant waste etc.

An automatically operated vehicle wash generally includes one or more vehicle washing devices such as a rotating brush, one or more means for supplying wash water such as nozzles or spray heads especially for dispensing wash water under pressure and one or more means for supplying a detergent composition which may be the same or different to the means for supplying wash water and are generally in the form of nozzles or spray heads. It may optionally further comprise one or more dryers. It is generally housed in a building. It has been found that with a conventional detergent, dirt from a vehicle can be spread throughout the building through the combined action of the rotating brushes and pressurised water. This can render the building difficult to clean. The advantage of the invention is that a micro-organism is sprayed throughout the building as well.

The composition according to the invention is preferably an aqueous composition. The micro organism is preferably a naturally occurring micro organism selected for its ability to digest organic matter. The selection of suitable micro organisms will be straight forward for one of skill in the art. The composition optionally additionally comprises a preservative, an alkali metal halide (particularly sodium chloride), one or more surfactants, and/or a dye. A surfactant for use in the invention is optionally ionic, particularly amphoteric or anionic, or non ionic. The surfactant is preferably in the form of a blend of different surfactants. Examples of suitable anionic surfactants include an alkali metal alkylbenzene sulphonate such as sodium dodecylbenzene sulphonate, for example Bio-Soft SDBS 60 (Trade name) manufactured by Stepan UK Ltd or an alkali metal alkyl ethoxysulphate, for example sodium lauryl ethoxy (3EO) sulphate such as Empicol ESC 3/G2 (Trade name) manufactured by Huntsman Surface Sciences. An example of a non-ionic surfactant is an alcohol ethoxylate such as POE-(11)-synthetic primary $C_{13}$/$C_{15}$ alcohol, for example Synperonic A11 (Trade name) manufactured by Uniqema.

The additive and/or composition preferably includes from 1 to 10 weight % of a micro-organism, preferably from 3 to 8 weight % of a micro-organism, more preferably about 5 weight % of a micro-organism. Preferably, the composition further includes from 0.1 to 2 weight % of a preservative, more preferably from 0.3 to 1 weight % of a preservative, most preferably about 0.5 weight % of a preservative. Preferably the composition includes from 1 to 40 weight % of a surfactant and/or a detergent, preferably from 5 to 30 weight %, most preferably about 20 weight % of a surfactant and/or a detergent. Preferably the composition includes from 0.5 to 5 weight % of an alkali metal halide, more preferably from 1 to 3 weight %, most preferably about 2 weight %.

According to a second aspect of the invention there is provided a method of reducing algae growth in a vehicle wash including means for supplying a detergent, means for supplying wash water and one or more vehicle washing devices, which method includes providing a micro-organism in the detergent composition and/or in the wash water. The method according to the second aspect of the invention preferably reduces build up of organic contaminants in a vehicle wash.

According to a third aspect of the invention there is provided a method of treating a vehicle wash with a micro-organism wherein the rate of treating is proportional to the rate of use of the vehicle wash which vehicle wash includes means for supplying wash water, means for supplying a detergent composition and one or more vehicle washing devices, wherein the method includes the step of providing a micro-organism in the wash water and/or in the detergent composition.

According to the invention there is further provided the use of a micro-organism in a detergent composition and/or in wash water for use in a vehicle wash.

The invention will now be further explained with reference to the following examples which are provided by way of illustration only.

EXAMPLE 1

A detergent composition was prepared by mixing together the ingredients shown in Table 1 to a total weight of 10 kg.

TABLE 1

| Ingredient | Amount/% w/w |
|---|---|
| Water | 72.983 |
| Bioban CS 1246 [a] | 0.500 |
| Bio-Soft SDBS 60 [b] | 7.800 |
| Empicol ESC3/G2 [c] | 10.000 |
| Drimarene Brill Green 3-XG [d] | 0.017 |
| Synperonic A11 [e] | 2.000 |
| Bichem GC 700L NS (10X NF) [f] | 5.000 |
| Sodium chloride | 1.700 |
| Total | 100.00 |

Wherein

[a] Bioban CS 1246 (Trade name) is a preservative (antibacterial agent) containing oxazolidine (1-aza-3,7-dioxa-5-ethylbicyclo (3.3.0) octane) manufactured by Angus Chemie GmbH.

[b] Bio-Soft SDBS 60 (Trade name) is an aqueous solution of a sodium dodecylbenzene sulphonate manufactured by Steppan UK Limited.

[c] Empicol ESC 3/G2 (Trade name) is an aqueous solution of sodium lauryl ethoxy (3EO) sulphate manufactured by Huntsman Surface Sciences.

[d] Drimarene Brill Green 3-XG (Trade name) is a reactive nickel phthalocyanine dyestuff, manufactured by Clariant UK Limited.

[e] Synperonic A11 (Trade name) is a POE-(II)-synthetic primary $C_{13}/C_{15}$ alcohol manufactured by Uniqema.

[f] Bichem GC 700L NS (10X NF) (Trade name) is a liquid preparation containing greater than 99% *Bacillus* microorganisms in a water base, manufactured by Novozymes Biologicals, France S.A.

The composition was used in an automatically operated car wash. After 8 weeks it was found that there was a 75% reduction in the growth rate of waste, complete elimination of foul odour in recycled water and reduction in slipperiness in the wash floor area. In other measured tests the reduction in the growth rate of waste was greater than 50%.

EXAMPLE 2

A wash water additive composition of 10 kg in weight was prepared by mixing the ingredients shown in Table 2 in the proportions given:

TABLE 2

| Ingredient | Amount/% w/w |
|---|---|
| Water | 94.983 |
| Drimarene Brill Green 3-XG | 0.017 |
| Bichem GC 700L NS (10X NF) | 5.000 |

The invention claimed is:

1. A composition suitable for use as a wash water additive in wash water in a vehicle wash which composition consists of:

(a) from 1 to 10 weight % of a micro-organism for degrading a substance selected from the group consisting of oil, fat and organic material;

(b) from 0.1 to 2 weight % of a preservative;

(c) from 1 to 40 weight % of a part selected from the group consisting of a surfactant, a detergent, and the combination thereof;

(d) from 1 to 3 weight % of an alkali metal halide; and (e) the balance being water.

2. A composition suitable for use as a detergent composition in a vehicle wash which composition consists of:

(a) from 1 to 10 weight % of a micro-organism for degrading a substance selected from the group consisting of oil, fat and organic material;

(b) from 0.1 to 2 weight % of a preservative;

(c) from 1 to 40 weight % of a part selected from the group consisting of a detergent or a detergent and a surfactant;

(d) from 1 to 3 weight % of an alkali metal halide; and (e) the balance being water.

3. A composition as defined in claim 1 wherein the micro-organism is naturally occurring.

4. A method of operating a vehicle wash which includes means for dispensing water, means for dispensing a detergent composition and one or more vehicle washing devices, comprising the step of providing a composition as defined in claim 1.

5. A method as defined in claim 4 wherein the vehicle wash is for a vehicle selected from the group consisting of a car, bus, lorry, caravan and a train.

6. A method as defined in claim 4 wherein the vehicle wash is operated automatically.

7. A method of reducing algae growth in a vehicle wash including means for supplying a detergent, means for supplying wash water and one or more vehicle washing devices, which method includes providing a composition as defined in claim 1.

8. A method of treating a vehicle wash with a micro-organism wherein the rate of treating is proportional to the rate of use of the vehicle wash which vehicle wash includes means for supplying wash water, means for supplying a detergent composition and one or more vehicle washing devices, comprising the step of providing a composition as defined in claim 1.

9. A composition as defined in claim 1, wherein the weight % of the micro-organism is from 3 to 8.

10. A composition as defined in claim 1, wherein the weight % of the micro-organism is about 5.

11. A composition as defined in claim 1, wherein the weight % of the preservative is from 0.3 to 1.

12. A composition as defined in claim 1, wherein the weight % of the preservative is about 0.5.

13. A composition as defined in claim 1, wherein the weight % of the part selected from the group consisting of a surfactant, a detergent, and the combination thereof is from 5 to 30.

14. A composition as defined in claim 1, wherein the weight % of the part selected from the group consisting of a surfactant, a detergent, and the combination thereof is about 20.

15. A composition as defined in claim 1, wherein the weight % of the alkali metal halide is about 2.

16. A composition suitable for use as a wash water additive in wash water in a vehicle wash which composition consists of:

(a) from 1 to 10 weight % of a micro-organism for degrading a substance selected from the group consisting of oil, fat and organic material;

(b) from 0.1 to 2 weight % of a preservative;

(c) from 1 to 40 weight % of a part selected from the group consisting of a surfactant, a detergent, and the combination thereof;

(d) from 1 to 3 weight % of an alkali metal halide;

(e) a dye and;

(f) the balance being water.

17. A composition as defined in claim 2, wherein the weight % of the micro-organism is from 3 to 8.

18. A composition as defined in claim 2, wherein the weight % of the micro-organism is about 5.

19. A composition as defined in claim 2, wherein the weight % of the preservative is from 0.3 to 1.

20. A composition as defined in claim 2, wherein the weight % of the preservative is about 0.5.

21. A composition as defined in claim 2, wherein the weight % of the part selected from the group consisting of a detergent or a detergent and a surfactant is from 5 to 30.

22. A composition as defined in claim 2, wherein the weight % of the part selected from the group consisting of a detergent or a detergent and a surfactant is about 20.

23. A composition as defined in claim 2, wherein the weight % of the alkali metal halide is from 1 to 3.

24. A composition as defined in claim 2, wherein the weight % of the alkali metal halide is about 2.

25. A composition suitable for use as a detergent composition in a vehicle wash which composition consists of:

(a) from 1 to 10 weight % of a micro-organism for degrading a substance selected from the group consisting of oil, fat and organic material;

(b) from 0.1 to 2 weight % of a preservative;

(c) from 1 to 40 weight % of a part selected from the group consisting of a detergent or a detergent and a surfactant;

(d) from 1 to 3 weight % of an alkali metal halide;

(e) a dye; and (f) the balance being water.

* * * * *